United States Patent [19]

Smith

[11] 4,159,677

[45] Jul. 3, 1979

[54] EMBOSSER

[75] Inventor: Franklin G. Smith, 2944 SE. Tibbetts, Portland, Oreg. 97202

[73] Assignee: Franklin G. Smith, Portland, Oreg.

[21] Appl. No.: 790,478

[22] Filed: Apr. 25, 1977

[51] Int. Cl.[2] ..... B44B 5/00

[52] U.S. Cl. ..... 101/23; 29/121.4; 29/132; 101/28

[58] Field of Search ..... 101/3, 5–8, 101/22–25, 28–32, 375, 378, 382 R, 383, 384, 247, 376; 72/352; 156/219; 425/363, 385, 406; D64/18; 29/121.4, 132

[56] References Cited

U.S. PATENT DOCUMENTS

| | | | |
|---|---|---|---|
| 1,386,411 | 8/1921 | Klund | 101/23 |
| 1,931,840 | 10/1933 | Campbell | 101/28 |
| 2,053,604 | 9/1936 | Dullinger | 101/378 X |
| 2,087,462 | 7/1937 | Zimmer | 101/384 |
| 2,160,613 | 5/1939 | Crafts | 101/247 |
| 2,229,133 | 1/1941 | Sands | 101/383 |
| 2,355,949 | 8/1944 | Boutwell | 101/382 R X |
| 2,996,983 | 8/1961 | Golding | 101/28 X |
| 3,088,399 | 5/1963 | Broderick | 101/23 |
| 3,403,621 | 10/1968 | Simson | 101/23 |
| 4,021,894 | 5/1977 | Poterala et al. | 29/121.4 X |

*Primary Examiner*—Edgar S. Burr
*Assistant Examiner*—James R. Feyrer
*Attorney, Agent, or Firm*—Klarquist, Sparkman, Campbell, Leigh, Hall & Whinston

[57] ABSTRACT

The specification discloses an embosser in which die-cast aluminum embossing segments are adhered by epoxy to a roll in rows along long spirals. The roll is driven, and is adjustable toward or away from a resilient backing roll, and co-acts therewith to emboss a web advanced therebetween.

3 Claims, 8 Drawing Figures

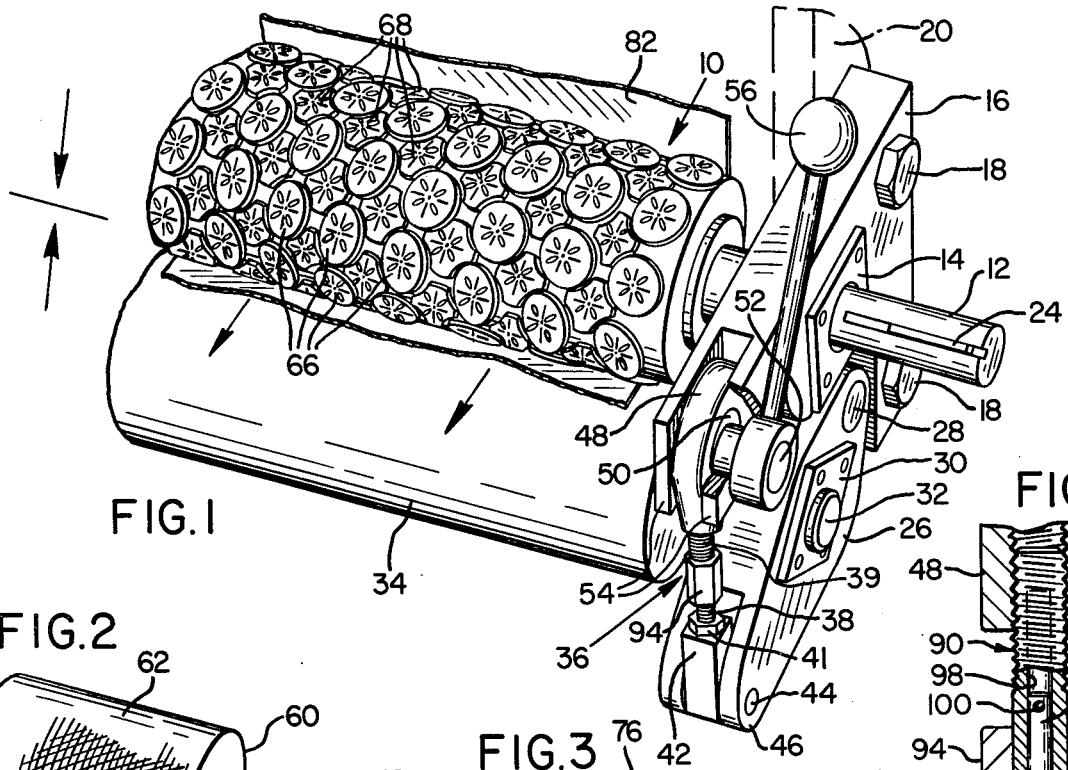
FIG.1
FIG.2
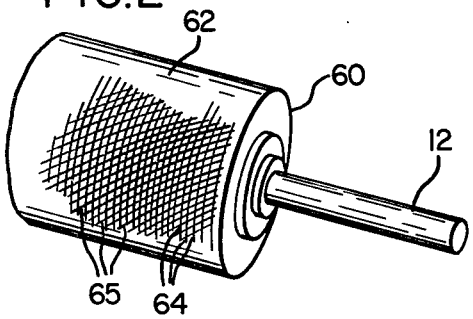
FIG.3
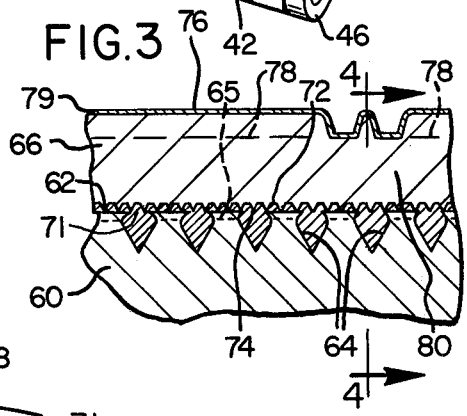
FIG.8
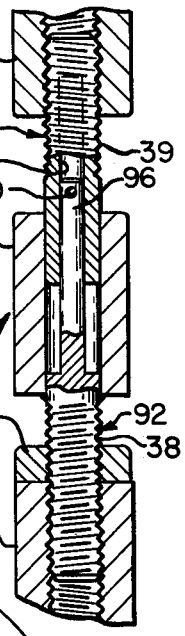
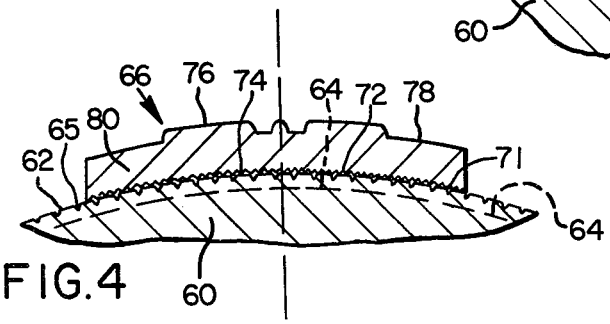
FIG.4
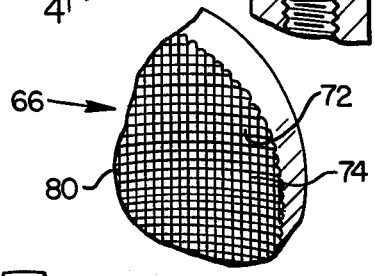
FIG.7
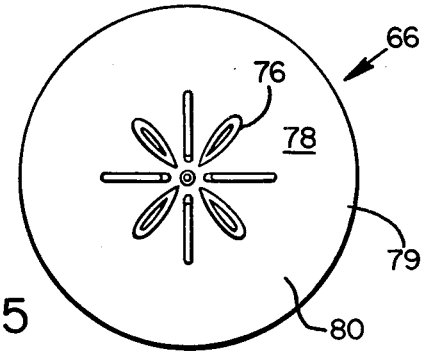
FIG.5
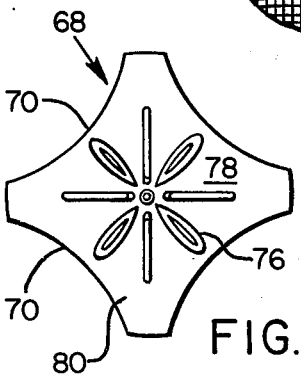
FIG.6

EMBOSSER

DESCRIPTION

This invention relates to an improved embosser and has for an object thereof the provision of a new and improved embosser.

Another object of the invention is to provide an embosser including a composite embossing roll having a multitude of embossing segments adhered to a roll.

A further object of the invention is to provide an embosser including a composite embossing roll having a multitude of diecast embossing segments of aluminum plated with industrial hard chromium and adhered by an epoxy compound in a pattern of skewed rows of segments on a threaded and knurled peripheral surface of a steel roll.

Another object of the invention is to provide an embosser including a rubber pressing roll mounted in self-aligning bearings carried by arms pivotally mounted on mounting plates bolted to a takeup stand and carrying self-aligning bearings journaling an embossing roll, a pair of adjustable connecting rods being connected to the arms and to a pair of cams movable by handles to adjust the spacing between the rolls.

In the drawings:

FIG. 1 is a fragmentary, perspective view of an improved embosser forming one embodiment of the invention;

FIG. 2 is a fragmentary, perspective view of a steel roll of an embossing roll of the embosser of FIG. 1 during fabrication of the embossing roll;

FIG. 3 is an enlarged, longitudinal, sectional view of the embossing roll;

FIG. 4 is an enlarged, transverse, sectional view taken along line 4—4 of FIG. 3;

FIG. 5 is an enlarged, top plan, view of an embossing segment of the embossing roll;

FIG. 6 is an enlarged, top plan, view of another embossing segment of the embossing roll;

FIG. 7 is an enlarged, fragmentary, bottom plan, view of the embossing segment of FIG. 5; and, FIG. 8 is an enlarged, fragmentary, elevation view of a portion of the embosser.

An improved embosser forming one specific embodiment of the invention includes a driven composite embossing roll 10 having a shaft 12 mounted in a pair of self-aligning bearings 14 bolted to a pair of mounting plates 16 secured by capscrews 18 to a takeup stand 20. A gear (not shown) is mounted on an end portion of the shaft 12, which has a keyway 24 therein, and is driven through gearing, chain or pulley (not shown), driving known web advancing means (not shown) of the stand. A pair of arms 26 mounted pivotally on pins 28 carried by lugs (not shown) on the plates carry self-aligning bearings 30 bolted to the arms and journaling shaft ends 32 of a rubber roll 34. A pair of turnbuckle connecting rods 36 having oppositedly handed threads 38 and 39 connect the arms to the plates. Nuts 41 hold the rods in adjusted positions. The connecting rods include end blocks 42 pivoted on pins 44 carried by clevis portions 46 of the arms, and also include bearing portions 48 on eccentric cams 50 keyed to shafts 52 carried by clevis portions 54 of the plates and manually rotatable by actuators in the form of handles 56 keyed to the shafts 52. It will be understood that the roll 34 may be driven with or instead of the roll 10.

The composite embossing roll 10 includes a steel roll member 60 integral with the shaft 12 and having a peripherally grooved cylindrical surface 62 having closely spaced grooves 64 and 65 arranged in a somewhat herringbone-like pattern. This is formed by cutting the groove 64 in a close spiral and deep and swaging the grooves 65 shallow and crosswise of the groove 64 to form overhanging mushroom-like portions. This gives an undercut structure. A multitude of circular embossing segments 66, and somewhat star-like segments 68 are adhered to the roll member 60 in a predetermined pattern by an epoxy cement 71 (FIG. 3). The segments are individually adhered to the roll member, with the segments in long spirals, preferably of about 15° relative to the longitudinal axis of the roll member, with each segment 68 centered between and spaced from four segments 66, the segments 68 having arcuate clearance portions 70. The segments all are arcuate, as best shown in FIG. 4, to fit precisely on the roll member 60 and each has a multitude of cupped indentations 72 on its inner surface portion for receiving the epoxy cement. Coordinately arranged lands 74 bear against the cylindrical surface of the roll member 60, and define the cupped indentations 72. Raised embossing designs 76 project radially outwardly from outer cylindrical faces 78 of the segments which are concentric to the surface 62. The designs 76 and the faces 78 have platings 79 of industrial chromium thereon. Bodies 80 of the segments 66 and 68 are of diecast aluminum or Zamac. The thickness of the platings 79 preferably is about 0.0005 thousandths of an inch. When the roll 10 is driven to advance a wide web 82 of material, for example, tissue in synchronism with the takeup, the designs 76 press the tissue into the rubber roll 34 to emboss the web 82 with a soft embossing. As illustrated in FIG. 5, the segments 66 are circular when viewed from the top even though they are arcuate when viewed as in FIG. 4. Similarly, the segments 68 are of equal length and width as viewed in FIG. 6 and are arcuate to fit concentrically on the roll 60.

Each screw 36 includes an upper screw section 90 (FIG. 8) having the thread 39 and a lower screw section 92 having the thread 38 and a drive nut 94 welded thereto. The section 92 also has a smaller diameter end portion 96 fitting in an axial bore 98 in the screw section 90 and held therein by a shear pin 100, which breaks in case of jamming of the rolls.

What is claimed is:

1. In an embosser,
a resilient backing member,
a cylindrical roll paralleling the member,
a plurality of embossing segments having arcuate inner surfaces and raised embossing portions on the outer surfaces,
and an adhesive fastening the segments to the roll,
the roll having a screw thread swaged crosswise in at least portions thereof to form overhangs.

2. In an embosser,
a resilient backing member,
a cylindrical roll paralleling the member and having an exterior surface portion,
a plurality of embossing segments having arcuate inner surfaces and raised embossing portions on the outer surfaces,
and adhesive means fastening the segments to the roll,
the exterior surface portion of the roll and the arcuate inner surfaces of the segments opposing the exterior surface portion being roughened, the roughness of said exterior surface portion being created by the surface portion being grooved in a criss-cross pattern and having undercut portions filled with the adhesive.

3. In an embosser, a resilient backing member, a cylindrical roll paralleling the member and having a peripheral surface portion, a plurality of embossing segments having arcuate inner surfaces and raised embossing portions on the outer surfaces, and means fastening the segments to the exterior surface portion of the roll and comprising an adhesive, the surface portion of the roll and the arcuate inner surfaces of the segments opposing the surface portion of the roll being roughened, the roughness of said surface portion of the roll including grooves being in a criss-cross pattern and having undercut portions filled with the adhesive, the roll having a sharp edged screw thread of a predetermined depth on its exterior surface portion and cross grooving of a lesser depth and formed by swaging to form the undercut portions, the thread and the swaging forming the criss-cross pattern.

* * * * *